US006418726B1

(12) United States Patent
Foust et al.

(10) Patent No.: US 6,418,726 B1
(45) Date of Patent: Jul. 16, 2002

(54) METHOD AND APPARATUS FOR CONTROLLING COMBUSTOR EMISSIONS

(75) Inventors: Michael Jerome Foust; Hukam Chand Mongia, both of West Chester, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/871,262

(22) Filed: May 31, 2001

(51) Int. Cl.[7] ..... F23R 3/60
(52) U.S. Cl. ..... 60/776; 60/748
(58) Field of Search ..... 60/776, 748, 746

(56) References Cited

U.S. PATENT DOCUMENTS

| | | | | |
|---|---|---|---|---|
| 2,551,276 A | | 5/1951 | Mc Mahan | 299/114 |
| 2,968,925 A | | 1/1961 | Blevans et al. | 60/39.74 |
| 3,302,399 A | | 2/1967 | Tini | 60/39.74 |
| 3,474,970 A | | 10/1969 | Simmons et al. | 239/404 |
| 3,630,024 A | | 12/1971 | Hopkins | 60/39.69 |
| 3,638,865 A | | 2/1972 | Mc Eneny et al. | 239/424 |
| 3,853,273 A | | 12/1974 | Bahr et al. | 239/402 |
| 3,899,884 A | | 8/1975 | Ekstedt | 60/39.74 |
| 3,980,233 A | | 9/1976 | Simmons et al. | 239/400 |
| 4,105,163 A | | 8/1978 | Davis, Jr. et al. | 239/406 |
| 4,198,815 A | | 4/1980 | Bobo et al. | 60/737 |
| 4,418,543 A | | 12/1983 | Faucher et al. | 60/742 |
| 4,567,857 A | | 2/1986 | Houseman et al. | |
| 4,584,834 A | | 4/1986 | Koshoffer et al. | 60/737 |
| 4,726,192 A | | 2/1988 | Willis et al. | 60/737 |
| 4,845,940 A | | 7/1989 | Beer | 60/732 |
| 4,974,416 A | | 12/1990 | Taylor | 60/737 |
| 5,020,329 A | | 6/1991 | Ekstedt et al. | 60/737 |
| 5,321,950 A | | 6/1994 | Shekleton et al. | 60/740 |
| 5,323,604 A | | 6/1994 | Ekstedt et al. | |
| 5,435,884 A | | 7/1995 | Simmons et al. | 216/100 |
| 5,540,056 A | | 7/1996 | Heberling et al. | 60/737 |
| 5,584,178 A | | 12/1996 | Naegeli et al. | |
| 5,590,529 A | | 1/1997 | Joshi et al. | |
| 5,613,363 A | | 3/1997 | Joshi et al. | |
| 5,623,827 A | * | 4/1997 | Monty | 60/747 |
| 5,647,538 A | | 7/1997 | Richardson | 239/405 |
| 5,737,921 A | | 4/1998 | Jones et al. | 60/740 |
| 5,970,715 A | | 10/1999 | Narang | |
| 6,070,410 A | | 6/2000 | Dean | |
| 6,141,967 A | | 11/2000 | Angel et al. | |
| 6,192,688 B1 | | 2/2001 | Beebe | |
| 6,195,607 B1 | | 2/2001 | Rajamani et al. | |
| 6,367,262 B1 | * | 4/2002 | Mongia et al. | 60/748 |

OTHER PUBLICATIONS

U.S. patent application Ser. No. 09/054,794, filed Apr. 3, 1998, entitled "Anti–Carboning Fuel–Air Mixer for a Gas Turbine Engine Combustor".

* cited by examiner

*Primary Examiner*—Ehud Gartenberg
(74) *Attorney, Agent, or Firm*—Rodney M. Young; Armstrong Teasdale LLP

(57) ABSTRACT

A combustor for a gas turbine engine operates with high combustion efficiency and low carbon monoxide, nitrous oxide, and smoke emissions during low, intermediate, and high engine power operations is described. The combustor includes a mixer assembly including a pilot mixer, a main mixer, and a mid-power and cruise mixer. The pilot mixer includes a pilot fuel injector, at least one swirler, and an air splitter. The main mixer extends circumferentially around the pilot mixer. The mid-power and cruise mixer extends between the main and pilot mixers and includes a plurality of fuel injection ports which inject fuel radially inwardly to facilitate radial and circumferential fuel-air mixing to provide a substantially uniform fuel and air distribution for combustion.

20 Claims, 3 Drawing Sheets

METHOD AND APPARATUS FOR CONTROLLING COMBUSTOR EMISSIONS

BACKGROUND OF THE INVENTION

This application relates generally to combustors and, more particularly, to gas turbine combustors.

Air pollution concerns worldwide have led to stricter emissions standards both domestically and internationally. Aircraft are governed by both Environmental Protection Agency (EPA) and International Civil Aviation Organization (ICAO) standards. These standards regulate the emission of oxides of nitrogen (NOx), unburned hydrocarbons (HC), and carbon monoxide (CO) from aircraft in the vicinity of airports, where they contribute to urban photo chemical smog problems. In general, engine emissions fall into two classes: those formed because of high flame temperatures (NOx), and those formed because of low flame temperatures which do not allow the fuel-air reaction to proceed to completion (HC & CO).

At least some known gas turbine combustors include between 10 and 30 mixers, which mix high velocity air with a fine fuel spray. These mixers usually consist of a single fuel injector located at a center of a swirler for swirling the incoming air to enhance flame stabilization and mixing. Both the fuel injector and mixer are located on a combustor dome.

In general, the fuel to air ratio in the mixer is rich. Since the overall combustor fuel-air ratio of gas turbine combustors is lean, additional air is added through discrete dilution holes prior to exiting the combustor. Poor mixing and hot spots can occur both at the dome, where the injected fuel must vaporize and mix prior to burning, and in the vicinity of the dilution holes, where air is added to the rich dome mixture.

One state-of-the-art lean dome combustor is referred to as a dual annular combustor (DAC) because it includes two radially stacked mixers on each fuel nozzle which appear as two annular rings when viewed from the front of a combustor. The additional row of mixers allows tuning for operation at different conditions. At idle, the outer mixer is fueled, which is designed to operate efficiently at idle conditions. At high power operation, both mixers are fueled with the majority of fuel and air supplied to the inner annulus, which is designed to operate most efficiently and with few emissions at high power operation. While the mixers have been tuned for optimal operation with each dome, the boundary between the domes quenches the CO reaction over a large region, which makes the CO of these designs higher than similar rich dome single annular combustors (SACs). Such a combustor is a compromise between low power emissions and high power NOx.

Other known combustors operate as a lean dome combustor. Instead of separating the pilot and main stages in separate domes and creating a significant CO quench zone at the interface, the mixer incorporates concentric, but distinct pilot and main air streams within the device. However, the simultaneous control of low power CO/HC and smoke emission is difficult with such designs because increasing the fuel/air mixing often results in high CO/HC emissions. The swirling main air naturally tends to entrain the pilot flame and quench it. To prevent the fuel spray from getting entrained into the main air, the pilot establishes a narrow angle spray. This may result in a long jet flames characteristic of a low swirl number flow. Such pilot flames produce high smoke, carbon monoxide, and hydrocarbon emissions and have poor stability.

BRIEF SUMMARY OF THE INVENTION

In an exemplary embodiment, a combustor for a gas turbine engine operates with high combustion efficiency and low carbon monoxide, nitrous oxide, and smoke emissions during low, intermediate, and high engine power operations. The combustor includes a mixer assembly including a pilot mixer, a main mixer, and a mid-power and cruise mixer. The pilot mixer includes a pilot fuel injector, at least one swirler, and an air splitter. The main mixer extends circumferentially around the pilot mixer. The mid-power mixer extends circumferentially between the main and pilot mixers, and includes a plurality of fuel injection ports and an axial air swirler that is upstream from the fuel injection ports.

During idle engine power operation, the pilot mixer is aerodynamically isolated from the main mixer, and only air is supplied to the main mixer. During increased power operations, fuel is also injected radially inward and supplied to the mid-power mixer, and the mid-power mixer axial swirler facilitates radial and circumferential fuel-air mixing. As the gas turbine engine is further accelerated to high power operating conditions, fuel is then also supplied to the main mixer. The main mixer conical swirler facilitate radial and circumferential fuel-air mixing to provide a substantially uniform fuel and air distribution for combustion. As a result, the fuel-air mixture is uniformly distributed within the combustor to facilitate complete combustion within the combustor, thus reducing high power operation nitrous oxide emissions.

DETAILED DESCRIPTION OF THE INVENTION

Figure 1:
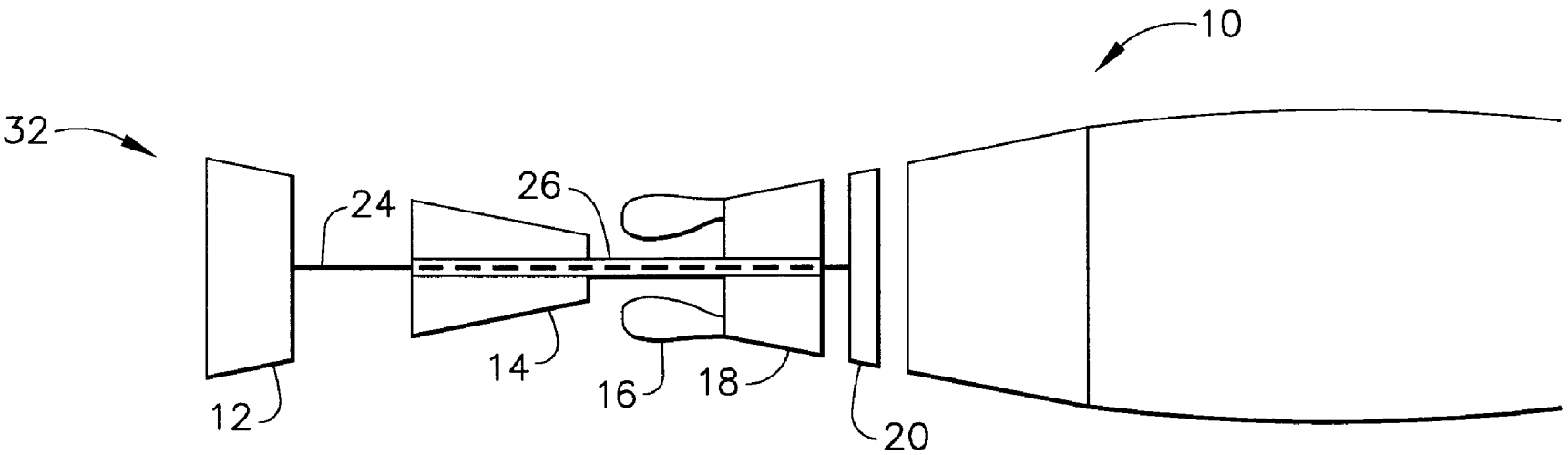
FIG. 1 is schematic illustration of a gas turbine engine including a combustor.

FIG. 1 is a schematic illustration of a gas turbine engine 10 including a low pressure compressor 12, a high pressure compressor 14, and a combustor 16. Engine 10 also includes a high pressure turbine 18 and a low pressure turbine 20.

In operation, air flows through low pressure compressor 12 and compressed air is supplied from low pressure compressor 12 to high pressure compressor 14. The highly compressed air is delivered to combustor 16. Airflow (not shown in FIG. 1) from combustor 16 drives turbines 18 and 20.

Figure 2:
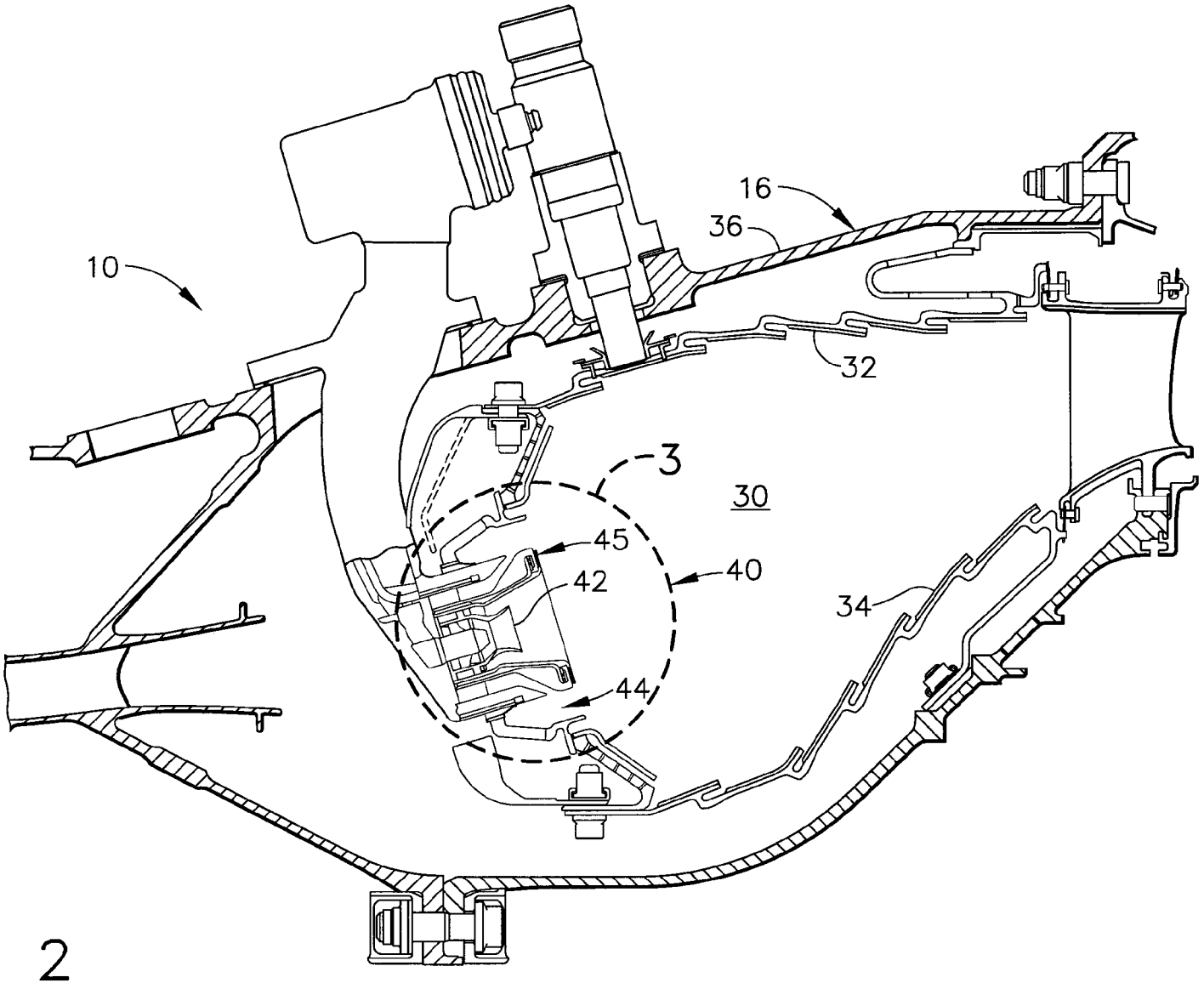
FIG. 2 is a cross-sectional view of a combustor that may be used with the gas turbine engine shown in FIG. 1.
Figure 3:
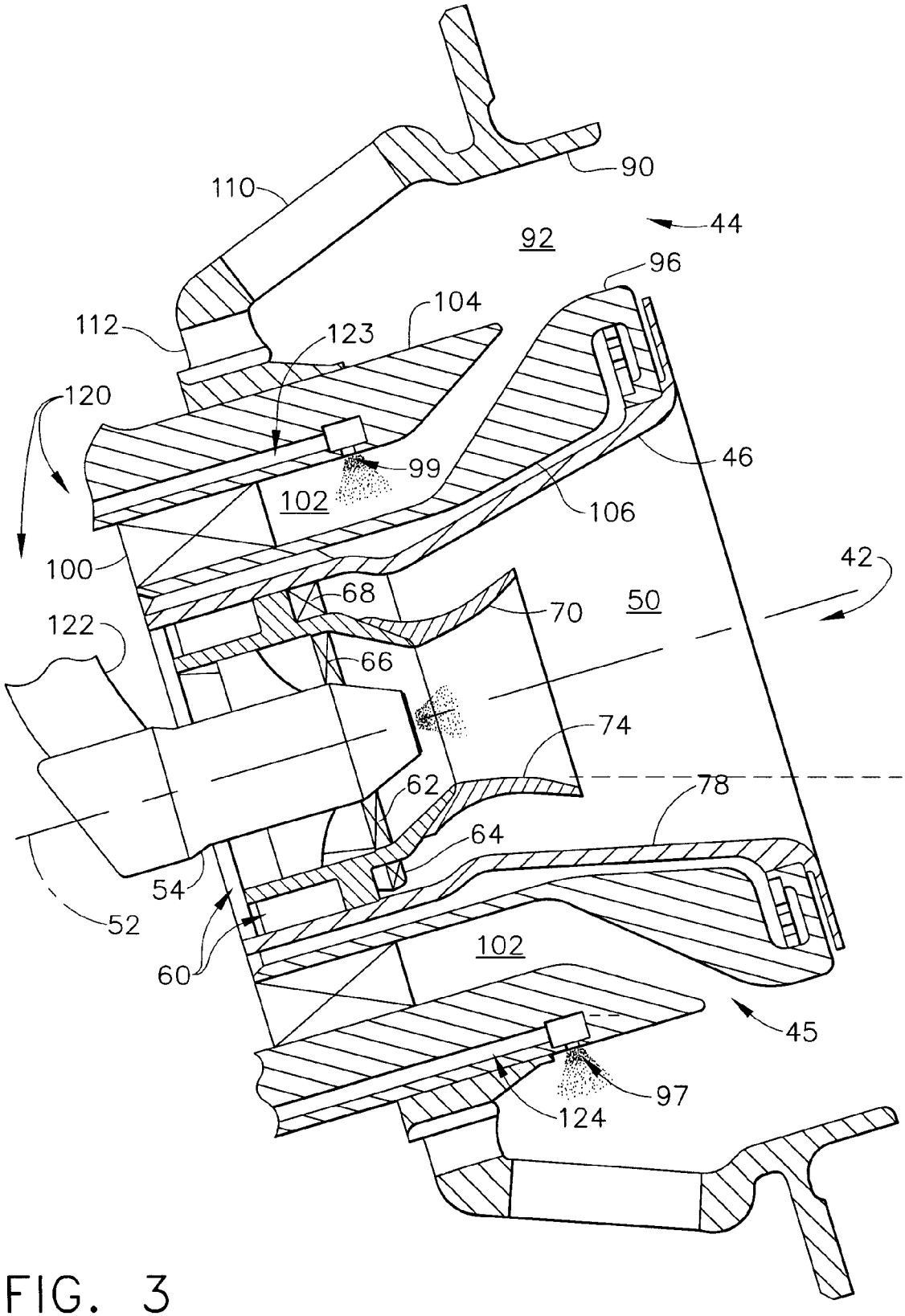
FIG. 3 is an enlarged view of a portion of the combustor shown in FIG. 2 taken along area 3.

FIG. 2 is a cross-sectional view of combustor 16 for use with a gas turbine engine, similar to engine 10 shown in FIG. 1, and FIG. 3 is an enlarged view of combustor 16 taken along area 3. In one embodiment, the gas turbine engine is a CFM engine available from CFM International. In another embodiment, the gas turbine engine is a GE90 engine available from General Electric Company, Cincinnati, Ohio.

Each combustor 16 includes a combustion zone or chamber 30 defined by annular, radially outer and radially inner liners 32 and 34. More specifically, outer liner 32 defines an outer boundary of combustion chamber 30, and inner liner 34 defines an inner boundary of combustion chamber 30. Liners 32 and 34 are radially inward from an annular combustor casing 36 which extends circumferentially around liners 32 and 34.

Combustor 16 also includes an annular dome mounted upstream from outer and inner liners 32 and 34, respectively.

The dome defines an upstream end of combustion chamber 30 and mixer assemblies 40 are spaced circumferentially around the dome to deliver a mixture of fuel and air to combustion chamber 30.

Each mixer assembly 40 includes a pilot mixer 42, a main mixer 44, and a mid-power and cruise mixer 45. Pilot mixer 42 includes an annular pilot housing 46 that defines a chamber 50. Chamber 50 has an axis of symmetry 52, and is generally cylindrical-shaped. A pilot fuel nozzle 54 extends into chamber 50 and is mounted symmetrically with respect to axis of symmetry 52. Nozzle 54 includes a fuel injector (not shown) for dispensing droplets of fuel into pilot chamber 50. In one embodiment, the pilot fuel injector supplies fuel through injection jets (not shown). In an alterative embodiment, the pilot fuel injector supplies fuel through injection simplex sprays (not shown).

Pilot mixer 42 also includes a pair of concentrically mounted swirlers 60. More specifically, swirlers 60 are axial swirlers and include a pilot inner swirler 62 and a pilot outer swirler 64. Pilot inner swirler 62 is annular and is circumferentially disposed around the pilot fuel injector. Each swirler 62 and 64 includes a plurality of vanes 66 and 68, respectively, positioned upstream from the pilot fuel injector. Vanes 66 and 68 are selected to provide desired ignition characteristics, lean stability, and low carbon monoxide (CO) and hydrocarbon (HC) emissions during low engine power operations.

A pilot splitter 70 is radially between pilot inner swirler 62 and pilot outer swirler 64, and extends downstream from pilot inner swirler 62 and pilot outer swirler 64. More specifically, pilot splitter 70 is annular and extends circumferentially around pilot inner swirler 62 to separate airflow traveling through inner swirler 62 from that flowing through outer swirler 64. Splitter 70 has a converging-diverging inner surface 74 which provides a fuel-filming surface during engine low power operations. Splitter 70 also reduces axial velocities of air flowing through pilot mixer 42 to allow recirculation of hot gases.

Pilot outer swirler 64 is radially outward from pilot inner swirler 62, and radially inward from an inner surface 78 of pilot housing 46. More specifically, pilot outer swirler 64 extends circumferentially around pilot inner swirler 62 and is radially between pilot splitter 70 and pilot housing 46. In one embodiment, pilot inner swirler vanes 66 swirl air flowing therethrough in the same direction as air flowing through pilot outer swirler vanes 68. In another embodiment, pilot inner swirler vanes 66 swirl air flowing therethrough in a first direction that is opposite a second direction that pilot outer swirler vanes 68 swirl air flowing therethrough.

Main mixer 44 includes an annular main housing 90 that defines an annular cavity 92. Main mixer 44 is concentrically aligned with respect to pilot mixer 42 and extends circumferentially around pilot mixer 42. More specifically, main mixer 44 extends circumferentially around mid-power and cruise mixer 45, and mid-power and cruise mixer 45 extends between pilot mixer 42 and main mixer 44. More specifically, mid-power and cruise mixer 45 includes an annular housing 96 that extends circumferentially around pilot mixer 42 and between pilot housing 46 and main housing 90.

Main mixer 44 also includes a plurality of injection ports 97 that extend through a mid-power housing 96. More specifically, main mixer injection ports 97 inject fuel radially outwardly into annular cavity 92 to facilitate circumferential and radial fuel-air mixing within main mixer 44. Each main mixer injection ports 97 is located to facilitate adjusting a degree of fuel-air mixing to achieve low nitrous oxide (NOx) emissions and to insure complete combustion during higher power main stage fuel and air mixing. Furthermore, each injection port location is also selected to facilitate reducing or preventing combustion instability.

Mid-power and cruise mixer 45 includes a plurality of injection ports 99 and an axial swirler 100. Axial swirler 100 is in flow communication with an inner channel 102 defined within mid-power and cruise mixer 45. More specifically, mid-power and cruise mixer 45 includes a radially outer surface 104 and a radially inner surface 106. Channel 102 extends between outer and inner surfaces 104 and 106, respectively, and discharges through radially outer surface 104. Swirler 100 is also between outer and inner surfaces 104 and 106, respectively.

Mid-power fuel injection ports 99 inject fuel radially inwardly from mid-power and cruise mixer 45 into channel 102. More specifically, mid-power and cruise mixer 45 includes a row of circumferentially-spaced injection port 99 that inject fuel radially inward into channel 102. A location of mid-power injection ports 97 is selected to adjust a degree of fuel-air mixing to achieve low nitrous oxide (NOx) emissions and to insure complete combustion during mid to high power main stage fuel and air mixing. Furthermore, the injection port location is also selected to facilitate reducing or preventing combustion instability.

Mid-power and cruise mixer housing 96 separates pilot mixer 42 and main mixer 44. Accordingly, pilot mixer 42 is sheltered from main mixer 44 during pilot operation to facilitate improving pilot performance stability and efficiency, while also reducing CO and HC emissions. Furthermore, pilot housing 46 is shaped to facilitate completing a burnout of pilot fuel injected into combustor 16. More specifically, pilot housing inner wall 78 is a converging-diverging surface that facilitates controlling diffusion and mixing of the pilot flame into airflow exiting main mixer 44. Accordingly, a distance between pilot mixer 42 and main mixer 44 is selected to facilitate improving ignition characteristics, combustion stability at high and lower power operations, and emissions generated at lower power operating conditions.

Main mixer 44 also includes a first swirler 110 and a second swirler 112, each located upstream from fuel injection ports 99. First swirler 110 is a conical swirler and airflow flowing therethrough is discharged at conical swirler angle (not shown). The conical swirler angle is selected to provide airflow discharged from first swirler 110 with a relatively low radial inward momentum, which facilitates improving radial fuel-air mixing of fuel injected radially outward from injection ports 99. In an alternative embodiment, first swirler 110 is split into pairs of swirling vanes (not shown) that may be co-rotational or counter-rotational.

Main mixer second swirler 112 is an axial swirler that discharges air in a direction substantially parallel to center mixer axis of symmetry 52 to facilitate enhancing main mixer fuel-air mixing. In one embodiment, main mixer 44 includes only first swirler 110 and does not include second swirler 112.

A fuel delivery system 120 supplies fuel to combustor 16 and includes a pilot fuel circuit 122, a mid-power and cruise fuel circuit 123, and a main fuel circuit 124. Pilot fuel circuit 122 supplies fuel to pilot fuel injector 48 and main fuel circuit 124 supplies fuel to main mixer 44 during mid to high power engine operations. Additionally, mid-power and cruise fuel circuit 123 supplies fuel to mid-power and cruise mixer 45 during mid-power and cruise engine operations. In the exemplary embodiment, independent fuel stages also supply fuel to engine 10 through combustor 16.

In operation, as gas turbine engine 10 is started and operated at idle operating conditions, fuel and air are supplied to combustor 16. During gas turbine idle operating conditions, combustor 16 uses only pilot mixer 42 for operating. Pilot fuel circuit 122 injects fuel to combustor 16 through the pilot fuel injector. Simultaneously, airflow enters pilot swirlers 60 and main mixer swirlers 110 and 112. The pilot airflow flows substantially parallel to center mixer axis of symmetry 52 and strikes pilot splitter 70 which directs the pilot airflow in a swirling motion towards fuel exiting the pilot fuel injector. The pilot airflow does not collapse a spray pattern (not shown) of the pilot fuel injector, but instead stabilizes and atomizes the fuel. Airflow discharged through main mixer 44 and mid-power and cruise mixer 45 is channeled into combustion chamber 30.

Utilizing only the pilot fuel stage permits combustor 16 to maintain low power operating efficiency and to control and minimize emissions exiting combustor 16. Because the pilot airflow is separated from the main mixer airflow, the pilot fuel is completely ignited and burned, resulting in lean stability and low power emissions of carbon monoxide, hydrocarbons, and nitrous oxide.

As gas turbine engine 10 is accelerated from idle operating conditions to increased power operating conditions, additional fuel and air are directed into combustor 16. More specifically, during increased power operating conditions, mid-power and cruise mixer 45 is also supplied fuel with mid-power and cruise fuel circuit 123 and injected radially inward through fuel injection ports 99 and into mid-power mixer channel 102. Mid-power and cruise mixer swirler 100 facilitates radial and circumferential fuel-air mixing to provide a substantially uniform fuel and air distribution for combustion. More specifically, airflow exiting swirler 100 forces the fuel to extend radially outward through channel 102 and into main mixer cavity 92 to facilitate fuel-air mixing and to enable combustor 16 to operate with a lean air-fuel mixture.

As gas turbine engine 10 is further accelerated to high power operating conditions, additional fuel and air are directed into combustor 16. In addition to the pilot fuel and mid-power fuel stages, during increased power operating conditions, main mixer 44 is supplied fuel with main fuel circuit 124 and injected radially outward through fuel injection ports 97 into main mixer cavity 92. Main mixer swirlers 110 and 112 facilitate radial and circumferential fuel-air mixing to provide a substantially uniform fuel and air distribution for combustion. More specifically, airflow exiting swirlers 110 and 112, and exiting mid-power mixer swirler 100, forces the fuel to extend radially outward to penetrate main mixer cavity 92 to facilitate fuel-air mixing and to enable main mixer 44 to operate with a lean-air fuel mixture. In addition, uniformly distributing the fuel-air mixture facilitates obtaining a complete combustion to reduce high power operation NOx emissions.

The above-described combustor is cost-effective and highly reliable. The combustor includes a mixer assembly that includes a pilot mixer, a main mixer, and a mid-power and cruise mixer. The pilot mixer is used during lower power operations, the mid-power mixer is used during mid-power operations, and the main mixer is used during high power operations. During idle power operating conditions, the combustor operates with low emissions and has only air supplied to the mid-power and main mixers. During increased power operating conditions, the combustor also supplies fuel to the mid-power and cruise mixer, and at high power operating conditions, fuel is also supplied to the main mixer. The mid-power and cruise mixer includes an axial swirler, and the main mixer includes a conical swirler to improve main mixer fuel-air mixing. The mid-power and cruise mixer facilitates uniformly distributing the fuel-air mixture radially and circumferentially to improve combustion and lower an overall flame temperature within the combustor. The lower operating temperatures and improved combustion facilitate increased operating efficiencies and decreased combustor emissions at high power operations. As a result, the combustor operates with a high combustion efficiency and low carbon monoxide, nitrous oxide, and smoke emissions.

While the invention has been described in terms of various specific embodiments, those skilled in the art will recognize that the invention can be practiced with modification within the spirit and scope of the claims.

What is claimed is:

1. A method for operating a gas turbine engine to facilitate reducing an amount of emissions from a combustor including a mixer assembly including a pilot mixer, a main mixer, and a mid-power and cruise mixer, the pilot mixer including a pilot fuel nozzle and a plurality of axial swirlers, the main mixer including a main swirler and a plurality of fuel injection ports, the mid-power and cruise mixer including a mixer and a plurality of fuel injection ports, said method comprising the steps of:

injecting fuel into the combustor through the pilot mixer, such that the fuel is discharged downstream from the pilot mixer axial swirlers;

directing airflow into the combustor through the main mixer such that the airflow is swirled with at least one of a conical swirler and a cyclone swirler prior to being discharged from the main mixer; and directing airflow between the pilot mixer and the main mixer through the mid-power and cruise mixer.

2. A method in accordance with claim 1 wherein the mid-power and cruise mixer includes a plurality of fuel injection ports and an axial swirler, said step of directing airflow between the pilot mixer and the main mixer further comprises the step of directing airflow through the mid-power and cruise axial swirler.

3. A method in accordance with claim 2 wherein said step of directing airflow between the pilot mixer and the main mixer further comprises the step of injecting fuel radially inward from the mid-power and cruise mixer.

4. A method in accordance with claim 2 wherein said step of directing airflow into the combustor through the main mixer further comprises the step of injecting fuel radially outward into the main mixer.

5. A method in accordance with claim 1 wherein at least one of the main mixer conical swirler and the main mixer cyclone swirler includes a first set of swirling vanes and a second set of swirling vanes, said step of step of directing airflow into the combustor further comprises the step of directing airflow through the main mixer to swirl a portion of the airflow in a first direction with the first set of swirling vanes and to swirl a portion of the airflow in a second direction with the second set of swirling vanes.

6. A method in accordance with claim 5 wherein said step of directing airflow through the main mixer to swirl a portion of the airflow further comprises the step of swirling the airflow in the same direction with the first and second sets of swirling vanes.

7. A combustor for a gas turbine comprising:

a pilot mixer comprising an air splitter, a pilot fuel nozzle, and a plurality of axial air swirlers upstream from said pilot fuel nozzle, said air splitter downstream from said pilot fuel nozzle, said air swirlers radially outward from and concentrically mounted with respect to said pilot fuel nozzle;

a main mixer radially outward from and concentrically aligned with respect to said pilot mixer, said main mixer comprising a plurality of fuel injection ports and a swirler comprising at least one of a conical air swirler and a cyclone air swirler, said main mixer swirler upstream from said main mixer fuel injection ports; and a mid-power and cruise mixer radially outward from and concentrically aligned with respect to said pilot mixer, said mid-power and cruise mixer comprising an axial swirler.

8. A combustor in accordance with claim 7 wherein said mid-power and cruise mixer comprises a plurality of fuel injection ports.

9. A combustor in accordance with claim 8 wherein said mid-power and cruise mixer fuel injection ports configured to inject fuel radially inward.

10. A combustor in accordance with claim 9 wherein said main mixer fuel injection ports configured to inject fuel radially outward.

11. A combustor in accordance with claim 7 wherein said at least one of a conical air swirler and a cyclone air swirler comprises first swirling vanes and second swirling vanes, said first swirling vanes configured to swirl air in a first direction, said second swirling vanes configured to swirl air in a second direction.

12. A combustor in accordance with claim 11 wherein said first swirling vanes first direction opposite said second swirling vanes second direction.

13. A combustor in accordance with claim 11 wherein said first swirling vanes first direction is identical said second swirling vanes second direction.

14. A mixer assembly for a gas turbine engine combustor, said mixer assembly configured to control emissions from the combustor and comprising a pilot mixer, a main mixer, and a mid-power and cruise mixer, said pilot mixer comprising a pilot fuel nozzle, and a plurality of axial swirlers upstream and radially outward from said pilot fuel nozzle, said main mixer radially outward from and concentric with respect to said pilot mixer, said main mixer comprising a plurality of fuel injection ports and a swirler upstream from said fuel injection ports, said main mixer swirler comprising at least one of a conical main swirler and a cyclone swirler, said mid-power and cruise mixer between said pilot mixer and said main mixer.

15. A mixer assembly in accordance with claim 14 wherein said mid-power and cruise mixer comprising a plurality of fuel injection ports configured to inject fuel radially inward.

16. A mixer assembly in accordance with claim 15 wherein said main mixer fuel injection ports configured to inject fuel radially outward.

17. A mixer assembly in accordance with claim 16 wherein said mid-power and cruise mixer further comprises an axial swirler.

18. A mixer assembly in accordance with claim 15 wherein said main mixer at least one of a conical main swirler and a cyclone air swirler comprises a plurality of swirling vanes.

19. A mixer assembly in accordance with claim 18 wherein said main mixer plurality of swirling vanes comprise first swirling vanes configured to swirl air in a first direction, and second swirling vanes configured to swirl air in a second direction opposite said first swirling vanes first direction.

20. A mixer assembly in accordance with claim 18 wherein said main mixer plurality of swirling vanes comprise first swirling vanes configured to swirl air in a first direction, and second swirling vanes configured to swirl air in a second direction identical said first swirling vanes first direction.

* * * * *